United States Patent [19]

Rose

[11] 3,971,611

[45] July 27, 1976

[54] SAFETY SOCKET FOR LAMPS AND THE LIKE

[76] Inventor: Manning I. Rose, 2301 Glenheath, Dayton, Ohio 45440

[22] Filed: Oct. 10, 1974

[21] Appl. No.: 513,632

[52] U.S. Cl. ..... 339/34; 339/41; 339/176 L; 200/51.09

[51] Int. Cl.[2] ..... H01R 13/44; H01R 33/30

[58] Field of Search ..... 339/34, 36, 41, 111, 339/176 L; 200/51.09, 51.17, 153 M

[56] References Cited

UNITED STATES PATENTS

| | | | |
|---|---|---|---|
| 1,901,040 | 3/1933 | Peroni et al. | 339/42 |
| 2,179,797 | 11/1939 | Nemeth | 200/51.09 |
| 2,221,345 | 11/1940 | Davis | 200/51.09 |
| 2,268,061 | 12/1941 | Richards | 200/51.09 |
| 2,306,741 | 12/1942 | Miller | 200/51.09 |
| 2,439,385 | 4/1948 | Goldberg | 200/51.09 |
| 2,688,669 | 9/1954 | Quill | 200/51.09 |
| 2,924,679 | 2/1960 | Brown | 200/51.09 X |
| 3,020,366 | 2/1962 | Dolph | 200/51.09 |
| 3,155,788 | 11/1964 | Drago | 200/51.09 |
| 3,579,171 | 5/1971 | Woodward | 200/51.09 |

*Primary Examiner*—Joseph H. McGlynn
*Assistant Examiner*—Craig R. Feinberg
*Attorney, Agent, or Firm*—Dybvig & Dybvig

[57] ABSTRACT

A socket base contact is self-biased to a position remote from its terminal and an insulating plate is driven by a spring between the contact and the terminal when a load device is removed from the socket. When a load device is inserted into the socket, the insulating plate may be manually moved to permit engagement between the base contact and its terminal. The force exerted against the base contact by a load device in the socket is sufficient to prevent the insulating plate from being driven between the base contact and its terminal.

10 Claims, 8 Drawing Figures

RESET

SAFETY SOCKET FOR LAMPS AND THE LIKE

BACKGROUND OF THE INVENTION

This invention relates to safety sockets of the type adapted to receive lamps or other load devices having a cylindrical socket shell contact and a center base contact. The socket of this invention is termed a safety socket because the likelihood that one inserting his fingers or a tool into the socket will receive a shock is remote.

Typical sockets which receive ordinary lamps with standard screw shell bases are unsafe since a person can insert his finger into an energized socket when the lamp is removed and touch the exposed contacts therein so as to receive a burn, a painful shock, or an injury. Usually there is no indicator, or an inadequate indicator, of the energized condition of the socket.

Safety sockets have been proposed which permit persons to lightly touch one or both socket contacts where either or both terminals have been de-energized by mechanical means when the lamp has been removed from the socket. Such devices are generally unsatisfactory because if pressure is applied to the same degree as a lamp base would apply pressure when inserted into the socket, the terminals will be re-energized and may cause shock and injury. Examples of such devices are disclosed in Davis U.S. Pat. No. 2,221,345 granted by the U.S. Patent Office on Nov. 12, 1940, which include a pin made from insulating material driven by a spring contact into covering relation to the socket base contact. However, one could manipulate the pin by hand away from covering relation to the base contact and thus receive a shock.

Safety sockets have been proposed having electrical terminal contacts retracted by mechanical means from the immediate socket area to preclude accidental contact with energized contacts when the lamp is removed. As the lamp is reinserted into the socket, the retracted terminals reappear in the socket area by the normal pressure of the lamp insertion. Such devices are generally unsatisfactory because if some pressure is applied by a finger of a person in the same manner as a lamp base would provide such pressure when inserted into the socket, the person thus inserting his finger will reactivate the terminals into the socket area and, again, may be subject to possible shock and injury.

Safety sockets have also been proposed where the electrical terminals are located in recesses and must be used with specially designed lamps for insertion into the socket. The recesses which contain the electrical terminal are of sufficiently small size as to prevent a person from touching the terminal when a finger is inserted into the socket. Such devices are also generally unsatisfactory because the requirement for specially designed lamp bases limit their usefulness.

Representative safety sockets are shown in the following United States patents:

| Inventor | Patent No. | Issue Date |
|---|---|---|
| Nemeth | 2,179,797 | Nov. 14, 1939 |
| Richards | 2,268,061 | Dec. 30, 1941 |
| Miller | 2,306,741 | Dec. 29, 1942 |
| Goldberg | 2,439,385 | Apr. 13, 1948 |
| Quill | 2,688,669 | Sept. 7, 1954 |
| Dolph | 3,020,366 | Feb. 6, 1962 |
| Drago | 3,155,788 | Nov. 3, 1964 |

-continued

| Inventor | Patent No. | Issue Date |
|---|---|---|
| Woodward | 3,579,171 | May 18, 1971 |

SUMMARY OF THE INVENTION

The present invention provides a socket with a circuit constructed to significantly reduce the likelihood of accidental shock and injury to a person who inserts a finger in the socket.

In accordance with this invention the socket is provided with a rotatably mounted insulating plate. When a load device is in the socket, the insulating plate is located in a position to have no effect on the operation of the socket. When the load device is removed from the socket, the base contact springs, by its inherent resiliency, out of engagement with its associated terminal. The insulating plate moves in a plane located between the terminal and the relaxed position of the base contact. When the load device is removed, the plate is powered by a drive spring into a position between the base contact and the terminal. Thereafter it must be mannually rotated back to its ineffective position in order to permit contact between the base contact and the terminal. When socket in accordance with this invention is used with a polarized plug and the base connector terminal is electrically connected to the source prong of the plug, no current can flow to the socket unless a load device is within the socket or unless the insulating plate is forcibly held away from its position between the base contact and its terminal.

The base contact is preferably constructed as a spring leaf or blade connected at one end to the socket base, the other end of which is self-biased to a position remote from its terminal. To accommodate the insulating plate, the socket base is divided into two parts between which the insulating plate can rotate and the socket base parts are provided with means journalling the plate for rotation. The plate is then remote from the socket shell so one could not engage or manipulate the plate by inserting a tool or finger in the shell. The drive spring for the plate can conveniently coact between the plate and one of the base parts. The housing portions of the socket are provided with elongate transverse slots through which a knob connected to or integral with the plate projects.

Movement of the plate is in a plane other than parallel to the center axis of the socket so that the plate will not move merely by application of pressure to the base contact.

If a load is removed from the socket while the socket is energized, one could not receive a shock upon engaging the base contact by his fingers or a tool unless at the same time the insulating plate were forcibly held out of its operating position against the spring bias. Therefore, the chance of accidental shock is quite remote.

DESCRIPTION OF THE PREFERRED EMBODIMENT

Figure 1:
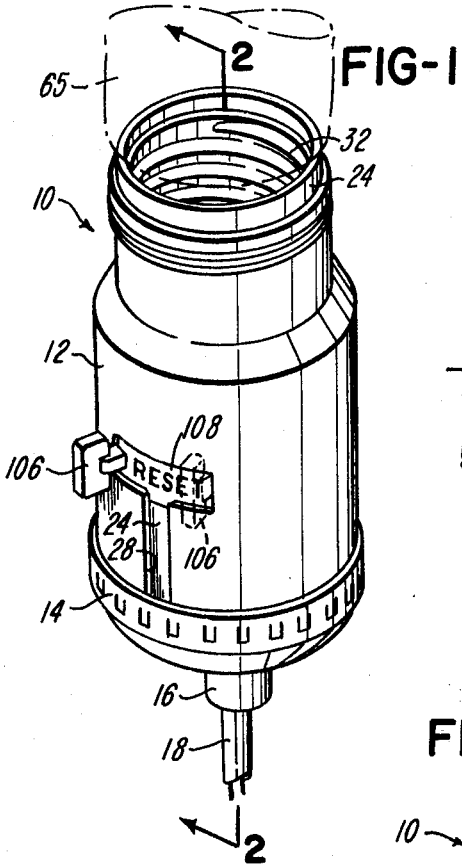
FIG. 1 is a perspective view of a safety socket made in accordance with this invention.
Figure 8:
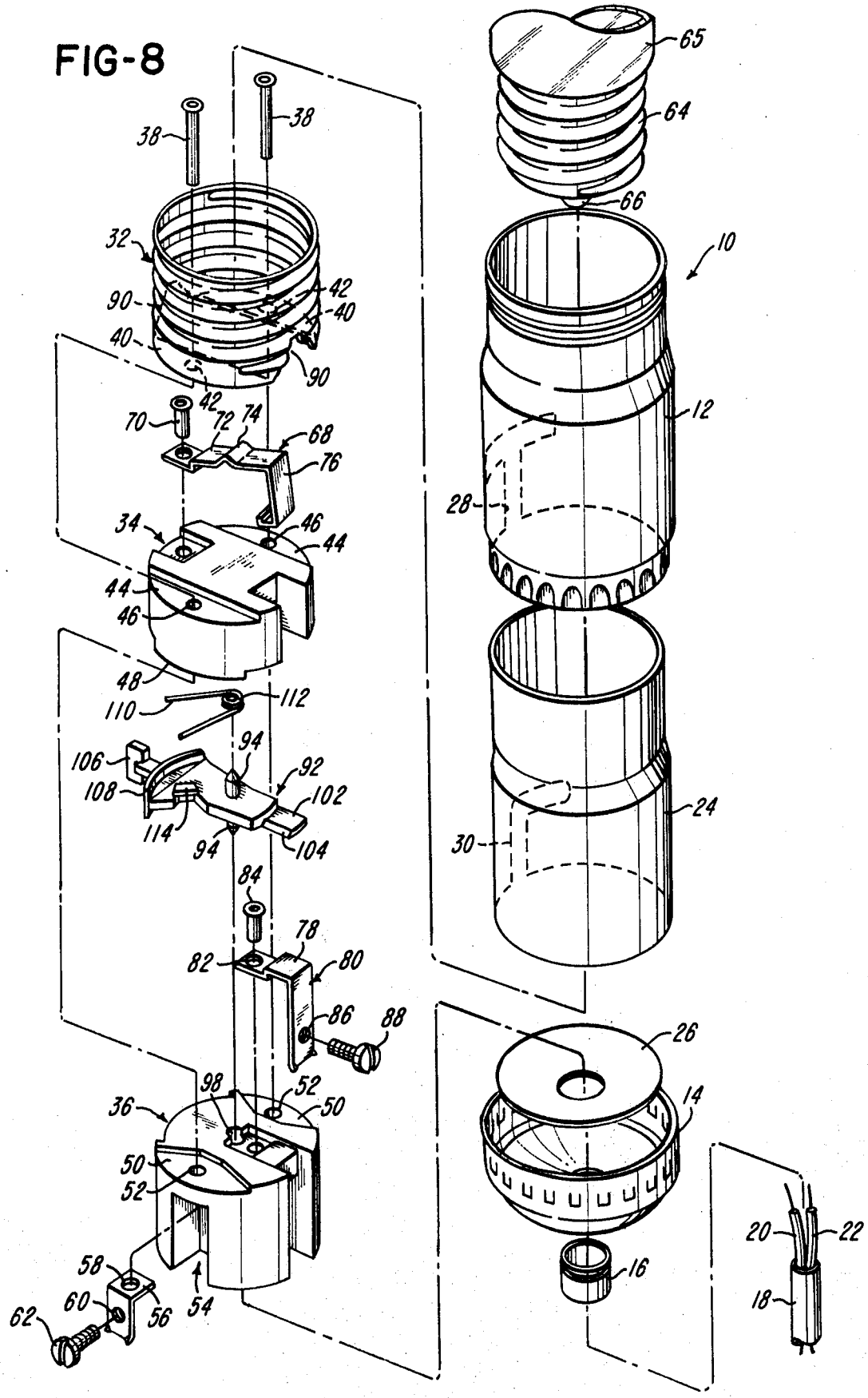
FIG. 8 is an exploded view of the safety socket.

With reference to FIGS. 1 and 8, a safety socket in accordance with this invention is generally designated 10 and includes a generally cylindrical metal housing or shell 12, a metal end cap 14 which receives an insulating hub 16 for receiving a cable 18 having two circuit wires 20 and 22. An insulating sleeve 24 is received within the shell 12 and an insulating disc 26 is received within the end cap 14, the disc 26 having a central aperture through which the cable 18 extends. The parts as thus far described are entirely conventional, except as will be described below. The shell 12 and the insulating sleeve 24 are cut away such that the shell 12 has a T-shaped slot 28 (FIG. 1) therein and the liner 24 has an inverted L-shaped cutout 30 therein, the head of which is coextensive with the head of the T-shaped slot 28.

A metal socket shell or shell contact 32 is mounted within the upper end of the shell 12 and liner 24 upon an upper, cylindrical base block member, generally designated 34, which in turn is mounted upon a lower, generally cylindrical base block member, generally designated 36. Socket shell 32 is of the conventional type adapted to receive various load devices having threaded base terminals. For convenience, the shell 32 is described as a socket for receiving lamp bases, it being understood that such sockets have general utility.

The socket shell 32 and the base block members 34 and 36 are rigidly fastened together with a pair of elongate rivets 38 passing through aligned apertures therein which are diametrically opposed with respect to the vertical centerline of the shell 32 and base parts 34 and 36. More particularly, the shell 32 is formed with flanges 40 having rivet receiving apertures 42 therein. The lower surfaces of the flanges 40 engage upwardly facing recessed shoulders 44 having rivet receiving apertures 46 extended therethrough. The confronting edges of the flanges 40 abut the vertical surfaces defining the straight edges of the shoulders 44. The resulting mating relationship between the metal shell 32 and the upper base part 34 enhances and maintains the rigidity of the parts when riveted together. For the same purpose, the lower surface of the upper base member 34 has downwardly projecting bosses 48 mating with upwardly facing recessed shoulders 50 formed on the lower base member 36. Shoulders 50 have rivet receiving apertures 52 therethrough. The lower base member 36 is cut away a short distance beneath the shoulders 50 as indicated at 54. An angled wire connector socket terminal 56 is located in one of the cutouts 54, the terminal 56 having a rivet receiving aperture 58 which also receives the rivet 38 passing through its associated aperture 52. The particular rivet 38 thus also serves a function of electrically connecting terminal 56 to the metal socket shell 32. Terminal 56 has a second, threaded aperture 60 for receiving a screw 62 which, as will be understood by those familiar with such devices, is used to clamp the bare end of the conductor wire 20 to the terminal 56. The assembled relation of parts described above is shown in FIG. 2.

Figure 2:
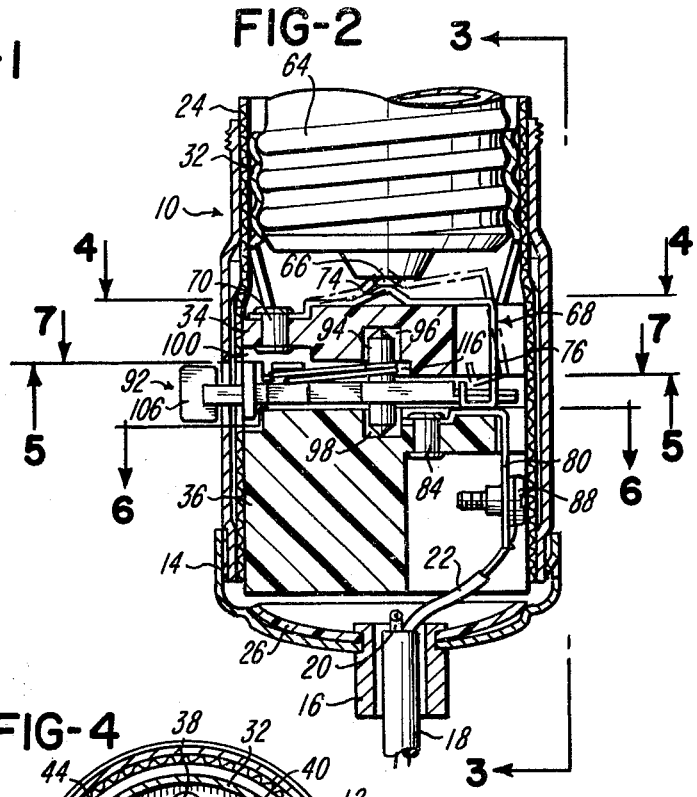
FIG. 2 is a cross sectional view of the socket taken along section line 2—2 of FIG. 1 and illustrating a lamp base within the socket.
Figure 3:
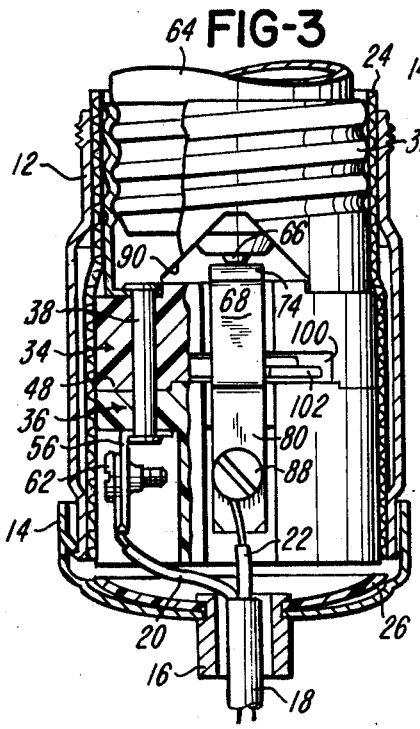
FIG. 3 is a side elevational view of the socket as viewed in the direction of arrows 3—3 of FIG. 2 with parts broken away and in cross section.
Figure 4:
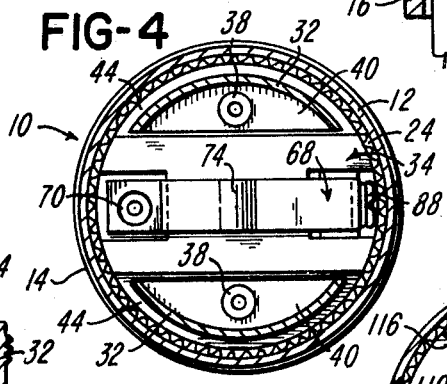
FIGS. 4, 5, 6 and 7 are cross sectional views of the safety socket taken along section lines 4—4, 5—5, 6—6 and 7—7, respectively, of FIG. 2.

As well known, the terminal 56, rivet 38 and metal shell 32 provide electrical connection between the circuit wire 20 and the cylindrical terminal 64 of a bulb 65. Wire 22 is connected to the base contact terminal 66 of the bulb in the following manner. With reference to FIGS. 2, 3 and 8, a spring blade contact, generally designated 68, is connected to the upper base member 34 by a rivet 70. Base contact 68 has a generally horizontal portion 72 extending diametrically across the top of the upper base member 34. Horizontal portion 72 has an upwardly extending contact bend 74 for engaging the bulb contact terminal 66. The free end of blade contact 68 opposite the end thereof riveted to the upper base part 34 is formed to a downwardly projecting J-shaped part 76. When the parts are assembled as shown in FIG. 3, the base of the J-shaped part 76 engages the top, horizontally extending surface portion 78 of a wire connector socket terminal, generally designated 80, which has an aperture 82 therein for receiving a rivet 84 which fastens the terminal 80 to the lower base part 36. Terminal 80 also has a threaded aperture 86 therein for receiving a screw 88 which clamps the bare end of the wire 22 thereto.

As shown in FIG. 8 and in phantom lines in FIG. 2, the spring blade contact 68 is inherently resilient and thus self-biasing to a relaxed position wherein the J-shaped part 76 thereof is spaced from and above the socket terminal 80. Accordingly, when there is no lamp bulb within the metal shell 32, the blade contact 68 will, by virtue of its self-bias, move out of engagement with the terminal 80. Accordingly, there is an open circuit between the wire 22 and the spring contact blade 68. Here it may be noted that the metal shell has conventional aligned notches 90 at its lower end straddling the confronting edges of the flanges 40 thereof. The spring blade 68 is located entirely between the flanges 40 and, even when it springs away from engagement with the terminal contact 80, it cannot engage any part of the metal shell 32 to create a shorting condition.

Figure 7:
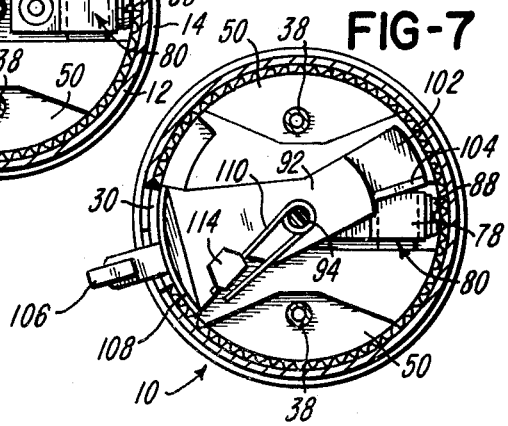

In accordance with this invention, upon removal of a lamp from the metal shell 32, whereupon as described above the spring blade contact 68 moves out of engagement with the terminal 80, accidental re-engagement of the blade contact 68 with the terminal 80 is prevented by an insulating plate generally designated 92 which is formed from any suitable plastic or other insulating material. With continued reference to FIGS. 3 and 8 and also with reference to FIG. 7, insulating plate 92 is mounted upon the lower base part 36 for rotation about the center vertical axis of the socket 10 by spindle-like projections 94 received within confronting recesses 96 and 98 in the lower and upper faces, respectively, of the upper base part 34 and the lower base part 36. The spindle-like projections 94 may comprise a single axle extending through and affixed to the plate 92 or may be formed integrally therewith. To permit rotation of the insulating plate 92, confronting surface portions of the upper and lower base parts 34 and 36 are spaced to provide a pocket or housing 100.

Insulating plate 92 has an end plate portion 102 of reduced thickness adjacent the spring blade 68 and the terminal 80. For reasons which will become apparent, end plate portion 102 has a beveled edge 104 confronting the blade 68 and terminal 80. The other end of the plate 92 is formed with a knob 106 projecting from an arcuate dial or face plate 108. As shown in FIG. 1, the knob 106 projects outwardly from the metal shell 12 and the face plate 108 can be viewed through the head of the T-shaped cutout 28 and the portion 30. For reasons which will become apparent, outer surface of face plate 108 is marked with the legend "reset" and it may have another suitable legend (not shown) such as "on".

Figure 5:
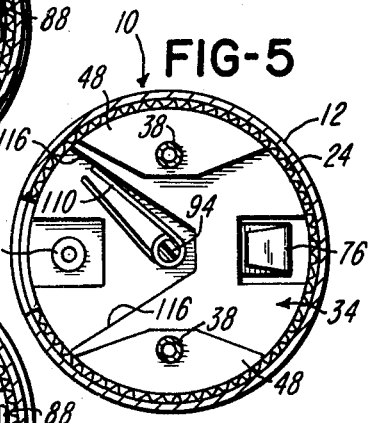
Figure 6:
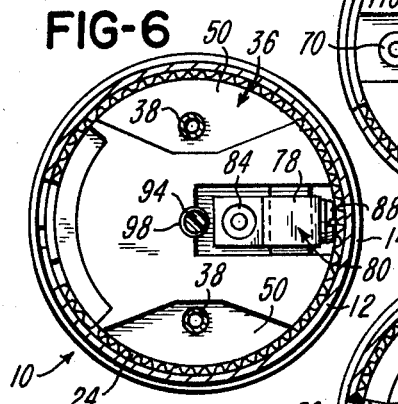

A wire spring 110 is provided having a coiled portion 112 encircling the upper spindle member 94. One end portion of wire spring 110 engages against an upwardly extending flange portion 114 on the insulating plate 92 and the other end portion of the wire spring 110 engages against a vertical surface portion 116 (FIGS. 2 and 5) projecting downwardly from the lower surface of the upper base part 34.

In operation the parts occupy the positions shown in full lines in FIGS. 2 and 3 during those times when a lamp is located within the socket. There it will be noted that the blase contact 68 engages terminal 80 and thus the circuit is completed from the bulb base contact 66 to conductor 22. Upon removal of the lamp from the socket, the blade contact 68 springs by virtue of its inherent resiliency from the full line position thereof illustrated in FIG. 2 to the phantom line position thereof. As soon as the lower edge of the J-shaped contact part 76 is above the beveled edge 104 of the plate portion 102, the spring 110 drives the insulating plate 92 into a position wherein the plate portion 102 is sandwiched between the blade contact 68 and the terminal 80. Because plate portion 102 is an insulator, no current can flow from the terminal 80 to the blade contact 68. The rotation of the insulating plate 92 can be stopped in any suitable fashion such as by engagement of the margin thereof with a side of one of the bosses 48. This position of the plate 92 is indicated by the full line position of knob 106 in FIG. 1. There it will be noted that the legend reset is visible. This legend indicates that the socket is inoperative and will remain so until the plate 92 is reset by forcibly moving the knob 106 to the phantom line position thereof shown in FIG. 1, whereupon plate portion 102 is returned to a position aside rather than between the blade contact 68 and the terminal 80.

When a lamp is replaced in the socket, the blade contact 68 will be forced downwardly toward engagement with the terminal 80, but until the plate 92 is reset as described above, the spring blade 68 merely bends as necessary to accommodate the force applied to it by the lamp base, and the socket is inoperative. The socket can then be rendered operative by resetting the plate 92, thus permitting contact 68 to engage the terminal 80. After the plate 92 is reset, i.e., its end plate portion 102 removed from between the contact 68 and the terminal 80, it is held in its reset position by engagement of the edge 104 with the adjacent side of the contact 80. It will be observed in FIG. 2 that the entire plate 92 is above the terminal 80 and also that the edge 104 is not a knife edge so that there is no opportunity for the bias of the spring 110 to overcome the contact 68 and force the plate portion 102 therebeneath unless and until the bulb is removed.

An important advantage of the construction described above is that the plate 92 is automatically moved by the spring 110 as a lamp is being removed from the socket. Once the plate 92 is moved to prevent engagement between the contact 68 and the terminal 80, no amount of force applied to the contact 68 can cause re-engagement with the terminal 80 except upon movement of the plate 92. Also, because the plate 92 is separated from the socket shell 32 by the upper base member 34, a finger or a tool inserted into the shell 32 could not engage or manipulate the plate 92. Therefore, the likelihood that one would receive a shock by reason of touching the blade contact 68 is quite remote. When the socket 20 is used with a polarized plug (not shown) of conventional construction with the source prong of the plug connected to conductor 22, no current whatsoever will flow to the socket contacts when the lamp is removed unless the plate 92 is forced out of its spring biased position.

Although the presently preferred embodiment of this invention has been described, it will be understood that within the purview of this invention various changes may be made within the scope of the appended claims.

Having thus described my invention, I claim:

1. In a safety socket of the type having a first contact and a second contact positioned to be engaged by a load device that is inserted and removed by movement along a predetermined axis extending through the socket, the improvement wherein said socket further includes a contact terminal separate from said second contact which is engaged by said second contact when said socket is operative, an insulator member supported in said socket for movement relative to both said contact terminal and said second contact, and means for moving said insulator member to a position wherein it is interposed between said terminal and said second contact in response to removal of a load device from said socket thereby to prevent engagement between said second contact and said terminal, said insulator member being movable from said position in a path other than parallel to the said axis and not movable by force applied thereto in a direction parallel to said axis so that a force must be applied to said insulator member in a direction other than parallel to said axis to permit re-engagement between said second contact and said terminal after a load device has been removed.

2. In a safety socket of the type having a shell contact and a base contact positioned to be engaged by a load device that is inserted and removed by movement along a predetermined axis extending through the socket, the improvement wherein said socket further includes a contact terminal separate from said base contact which is engaged by said base contact when said socket is operative, an insulator member, and means for moving said insulator member to a position wherein it is interposed between said terminal and said base contact in response to removal of a load device from said socket thereby to prevent engagement between said base contact and said terminal, said insulator member being movable from said position in a path other than parallel to the said axis and not movable by force applied thereto in a direction parallel to said axis so that a force must be applied to said insulator member in a direction other than parallel to said axis to permit re-engagement between said base contact and said terminal after a load device has been removed.

3. The improvement of claim 2 wherein the movement of said insulator member is relative to both said contact terminal and said base contact.

4. The improvement of claim 2 wherein said shell contact is mounted upon a base means and said insulator member is supported by said base means remote from said shell contact.

5. The improvement of claim 4 wherein said base means includes relatively fixed first and second base members and wherein said shell contact and said base contact are mounted upon said first base member, said insulator member and said terminal being mounted upon said second base member.

6. In a safety socket of the type having a shell contact and a base contact, the improvement wherein said socket further includes a contact terminal separate from said base contact which is engaged by said base contact when said socket is operative, said base contact comprises a spring blade member having an inherent resiliency and being self-biased away from engagement with said terminal, an insulator member, and means for interposing said insulator member between said terminal and said base contact in response to removal of a load device from said socket thereby to prevent engagement between said base contact and said terminal.

7. The improvement of claim 6 wherein said insulator member comprises a plate structure pivotally mounted upon said base means and wherein said means for interposing said insulator member includes a spring engaging said plate member to bias said plate member toward a rotated position between said base contact and said terminal.

8. The improvement of claim 7 wherein said blade member is forced toward engagement with said terminal by engagement with the base of a load device therewith when a load device is located in said socket and wherein the bias of said spring is overcome by the engagement of an edge portion of said plate member with said base contact when the base of a load device is in said socket.

9. The improvement of claim 8 wherein said socket further includes housing means and wherein said plate member has a knob portion projecting through slot means in said housing means whereby said plate member may be forcibly pivoted against the bias of said spring away from the position in which it prevents engagement of said terminal by said base contact.

10. The improvement of claim 9 wherein said plate member further includes a face plate portion visible through said slot means having one or more legends thereon indicative of the location of said plate member relative to said base contact and said terminal.

* * * * *

UNITED STATES PATENT OFFICE

CERTIFICATE OF CORRECTION

PATENT NO. : 3,971,611

DATED : July 27, 1976

INVENTOR(S) : Manning I. Rose

It is certified that error appears in the above-identified patent and that said Letters Patent are hereby corrected as shown below:

Col. 2, line 25, "mannually" should be ---manually---.
Col. 5, line 16, "blase" should be ---blade---.
Col. 6, line 4, "socket 20" should be ---socket 10---.

Signed and Sealed this

Thirtieth Day of November 1976

[SEAL]

*Attest:*

RUTH C. MASON
*Attesting Officer*

C. MARSHALL DANN
*Commissioner of Patents and Trademarks*